US007208728B2

(12) United States Patent
Hashimoto et al.

(10) Patent No.: US 7,208,728 B2
(45) Date of Patent: Apr. 24, 2007

(54) MASS SPECTROMETER

(75) Inventors: Yuichiro Hashimoto, Tokyo (JP); Takashi Baba, Kawagoe (JP); Hideki Hasegawa, Tokyo (JP); Izumi Waki, Tokyo (JP)

(73) Assignee: Hitachi High-Technologies Corporation, Tokyo (JP)

( * ) Notice: Subject to any disclaimer, the term of this patent is extended or adjusted under 35 U.S.C. 154(b) by 0 days.

(21) Appl. No.: 10/997,896

(22) Filed: Nov. 29, 2004

(65) Prior Publication Data

US 2005/0127290 A1 Jun. 16, 2005

(30) Foreign Application Priority Data

Dec. 16, 2003 (JP) ..... 2003-417894

(51) Int. Cl.
*H01J 49/00* (2006.01)

(52) U.S. Cl. ..... 250/287

(58) Field of Classification Search ..... 250/292
See application file for complete search history.

(56) References Cited

U.S. PATENT DOCUMENTS 5,689,111 A 11/1997 Dresch et al.
5,783,824 A 7/1998 Baba et al.
6,177,668 B1 1/2001 Hager
6,504,148 B1 * 1/2003 Hager ..... 250/282
6,507,019 B2 1/2003 Chernushevich et al.
6,627,883 B2 * 9/2003 Wang et al. ..... 250/292
6,833,544 B1 * 12/2004 Campbell et al. ..... 250/282

OTHER PUBLICATIONS

Krutchinsky, A.N., et al., "Collisional Focusing of Ions in the Electrospray TOF Mass Spectrometer", Processings of the 43rd ASMS Conference on Mass Spectrometry and Allied Topics, May 21-26, 1995, p. 126.

* cited by examiner

*Primary Examiner*—David Vanore
(74) *Attorney, Agent, or Firm*—Reed Smith LLP; Stanley P. Fisher, Esq.; Juan Carlos A. Marquez, Esq.

(57) ABSTRACT

A mass spectrometer capable of analyzing a wide mass range with high sensitivity and high mass accuracy. A mass spectrometer has an ionization source generating ions; an ion transfer optics transferring the ions; a first linear trap accumulating the ions and ejecting the ions in the specific mass range; a second linear trap having an end electrode disposed at the exit end ejecting the ions to change a DC potential gradient relative to a DC potential of the end electrode and trapping the ions ejected from the first linear trap to repeatedly eject them in pulse form; a time-of-flight mass spectrometer accelerating the ions ejected from the second linear trap in the orthogonal direction to detect them; and a controller changing the time duration of the ions in which the ions are ejected from the second linear trap or delay time from the completion of ejection to application of an accelerating voltage of the time-of-flight mass spectrometer according to the mass range of the ions ejected from the first linear trap to the second linear trap.

5 Claims, 16 Drawing Sheets

MASS SPECTROMETER

CLAIM OF PRIORITY

The present invention claims priority from Japanese application JP 2003-417894 filed on Dec. 16, 2003, the content of which is hereby incorporated by reference on to this application.

BACKGROUND OF THE INVENTION

The present invention relates to mass spectrometers.

In mass spectrometers used for proteome analysis, orthogonal time-of-flight mass spectrometers (hereinafter, called orthogonal-TOF mass spectrometers), that is, time-of-flight mass spectrometers in which the ion introduction direction into the TOF part is orthogonal to the ion acceleration direction in the TOF part are widely used. How analysis of these has been conducted will be described below.

There is a report about the orthogonal-TOF mass spectrometer (for instance, see A. N. Krutchinsky et al.: Proceedings of the 43rd ASMS Conference on Mass Spectrometry and Allied Topics, 1995, p. 126 (Conventional Method 1)). Multipole rods are provided in a vacuum chamber evacuated to about 10 Pa directly before the TOF part. In a region surrounded by the multipole rods, ions collided with a gas lose kinetic energy to be focused near the center axis. The ions which have passed through the multipole rods to be introduced into the TOF part are accelerated in the direction orthogonal to the ion introduction direction. The initial distribution of position and the initial distribution of kinetic energy in the acceleration direction are reduced to increase the mass resolution in the TOF part.

There is a report in which this method is improved to increase the duty cycle of the orthogonal-TOF mass spectrometer (for instance, see U.S. Pat. No. 5,689,111 (Conventional Method 2)). A potential gradient is provided between multipole rods in the previous stage of the TOF part and an end lens disposed on the exit side to trap ions in a multipole chamber. The potential gradient is inverted in pulse to eject the ions trapped in the multipole chamber to the TOF part. An accelerating voltage is applied in synchronization with the timing at which the ejected ions reach the accelerator of the TOF. The duty cycle in the specific mass range can be increased to almost 100%.

There is a report in which the duty cycle in the orthogonal-TOF mass spectrometer in Qq-TOF combining a quadrupole mass filter with the orthogonal-TOF mass spectrometer (for instance, see U.S. Pat. No. 6,507,019 (Conventional Method 3)). In the Qq-TOF, a collision cell is provided between a quadrupole mass filter selecting precursor ions and the TOF part. The collision cell is a vacuum chamber evacuated to about 10 Pa in which multipole rods are arranged. The ions selected by the quadrupole mass filter are dissociated by collision with a gas in the region surrounded by the multipole rods, and then lose kinetic energy by collision with the gas to be focused near the center axis. A potential gradient is provided between the multipole rods in the previous stage of the TOF part and an end lens disposed on the exit side to trap the ions in the multipole chamber. The potential gradient is inverted in pulse to eject the ions trapped in the multipole chamber to the TOF part. An accelerating voltage is applied in synchronization with the timing at which the ejected ions reach the accelerator of the TOF. The duty cycle in the specific mass range can be increased to almost 100%.

In a method of ejecting ions in the specific mass range from a multipole linear trap in mass spectrometers used for proteome analysis, how analysis of these has been conducted will be described below.

There is a report about a method of ejecting ions in the specific mass range from a multipole linear trap (for instance, see U.S. Pat. No. 5,783,824 (Conventional Method 4)). In this method, vane electrodes are inserted between multipole rods to apply a DC voltage for forming an electrostatic harmonic potential in an axial direction. A supplemental AC voltage is applied between the vane electrodes divided into two or more in the axial direction to resonate ions in the axial direction. The resonant ions are beyond the electrostatic harmonic potential formed in the axial direction to be ejected in the axial direction. The resonant frequency is different depending on mass. The ions can be mass selectively ejected in the axial direction.

There is a report about a method of ejecting ions in the specific mass range from a quadrupole linear trap (for instance, see U.S. Pat. No. 6,177,668 (Conventional Method 5)). A DC potential is applied between an end lens and quadrupole rods to accumulate ions in a linear trap. A supplemental AC voltage is applied between the quadrupole rods or between the quadrupole rods and the end lens to come into resonance with a quadrupole or octapole component in the diameter direction which is originally formed in the quadrupole linear trap. Kinetic energy provided in the diameter direction is converted in an axial direction. The ions are beyond a DC potential formed between the end lens and the quadrupole rods to be ejected in the axial direction. The resonant frequency is different depending on mass. The ions can be mass selectively ejected in the axial direction.

There is a report in which the duty cycle in the specific mass range in the MS/MS analysis mode by combining ejection in the specific mass range from amultipole linear trap with the orthogonal-TOF mass spectrometer (for instance, see U.S. Pat. No. 6,504,148 (Conventional Method 6)). A mass analyzer, collision cell, and mass spectroscopic means are provided. The method of mass selectively ejecting ions disclosed in Conventional Method 5 is used for at least one of the mass analyzer and ejection from the collision cell. The duty cycle in the specific mass range can be increased.

SUMMARY OF THE INVENTION

The above-described Conventional Method 1 has the problem that only a duty cycle of 40% or below can be obtained. A stream of ions is continuously introduced from the multipole rods into the TOF part. Only ions in the accelerator region (and the region to the detector) can be used. The duration in which ions ejected from the end lens reach the accelerator of the TOF part is different depending on mass. The duty cycle is largely different depending on mass. In particular, the duty cycle at a low mass tends to be lower.

Conventional Methods 2 and 3 have the problem that a mass range which can obtain a high duty cycle is extremely limited. The duration in which ions ejected from the end lens reach the accelerator of the TOF part is different depending on mass. Ions outside the specific mass range can obtain only a very low duty cycle. A typical mass distribution which can obtain a duty cycle of 50% or above is in the range of 1M to 2M (for instance, a mass of 500 to 1000). In a low mass region (for instance, a mass of 300 or below) and a high mass region (for instance, a mass of 1600 or above), the duty cycle is 0.

Conventional Methods 4 and 5 disclose only the method of mass selectively ejecting ions from a multipole linear trap. A method of increasing the duty cycle of the orthogonal-TOF mass spectrometer is not described.

As the problem common to Conventional Methods 1 to 5, a large detector (MCP, Multi channel plate) is necessary to obtain a mass window which is as wide as possible. These significantly increase the cost. In particular, when using an ADC (Analog-to-digital converter) for data conversion, increased signal pulse width due to the larger detector lowers the mass resolution.

Conventional Method 6 does not describe a method of increasing the duty cycle in a wide mass range not depending on the MS/MS analysis of the TOF part.

The present invention has been made in view of such points. An object of the present invention is to provide a mass spectrometer having a high duty cycle in a wide mass range.

To achieve the above object, a mass spectrometer of the present invention has the following features:

(1) A mass spectrometer has an ionization source generating ions; an ion transfer optics transferring the ions; a first linear trap accumulating the ions and ejecting the ions in the specific mass range; a second linear trap having an end lens disposed at the exit end ejecting the ions to change a DC potential gradient relative to a DC potential of the end electrode and trapping the ions ejected from the first linear trap for repeatedly ejecting them in pulse form; a time-of-flight mass spectrometer accelerating the ions ejected from the second linear trap in the orthogonal direction to detect them; and a controller changing the time duration of the ions in which the ions are ejected from the second linear trap or delay time from the completion of ejection to application of an accelerating voltage of the time-of-flight mass spectrometer according to the mass range of the ions ejected from the first linear trap to the second linear trap.

(2) In the mass spectrometer of the (1), the first linear trap has four or more multipole rods, and vane electrodes divided into two or more in an axial direction which can form a harmonic potential in the axial direction of the linear trap are inserted between the rods to apply a supplemental AC voltage to at least one of the divided vane electrodes for ejecting the ions in the specific mass range to the second linear trap.

(3) In the mass spectrometer of the (1), the first linear trap has four quadrupole rods and electrodes each disposed at the inlet end introducing ions and at the exit end ejecting ions, a potential gradient formed by the electrode disposed at the exit end forms a potential trapping ions, and a supplemental AC voltage is applied to any one of the quadrupole rods and the electrode at the exit end to eject the ions in the specific mass range to the second linear trap.

(4) In the mass spectrometer of the (1), the first linear trap and the second linear trap are constructed by the same multipole rods.

(5) In the mass spectrometer of the (2) or (3) the second linear trap accumulates ions by increasing and decreasing the potential of the end lens disposed at the exit end from the potential on the center axis of the rods to eject them to the time-of-flight mass spectrometer.

According to the present invention, a mass spectrometer which can analyze a wide mass range with high sensitivity and high mass accuracy.

DETAILED DESCRIPTION OF THE PREFERRED EMBODIMENTS

Embodiments of the present invention will be described below in detail with reference to the drawings.

(Embodiment 1)

Figure 1:
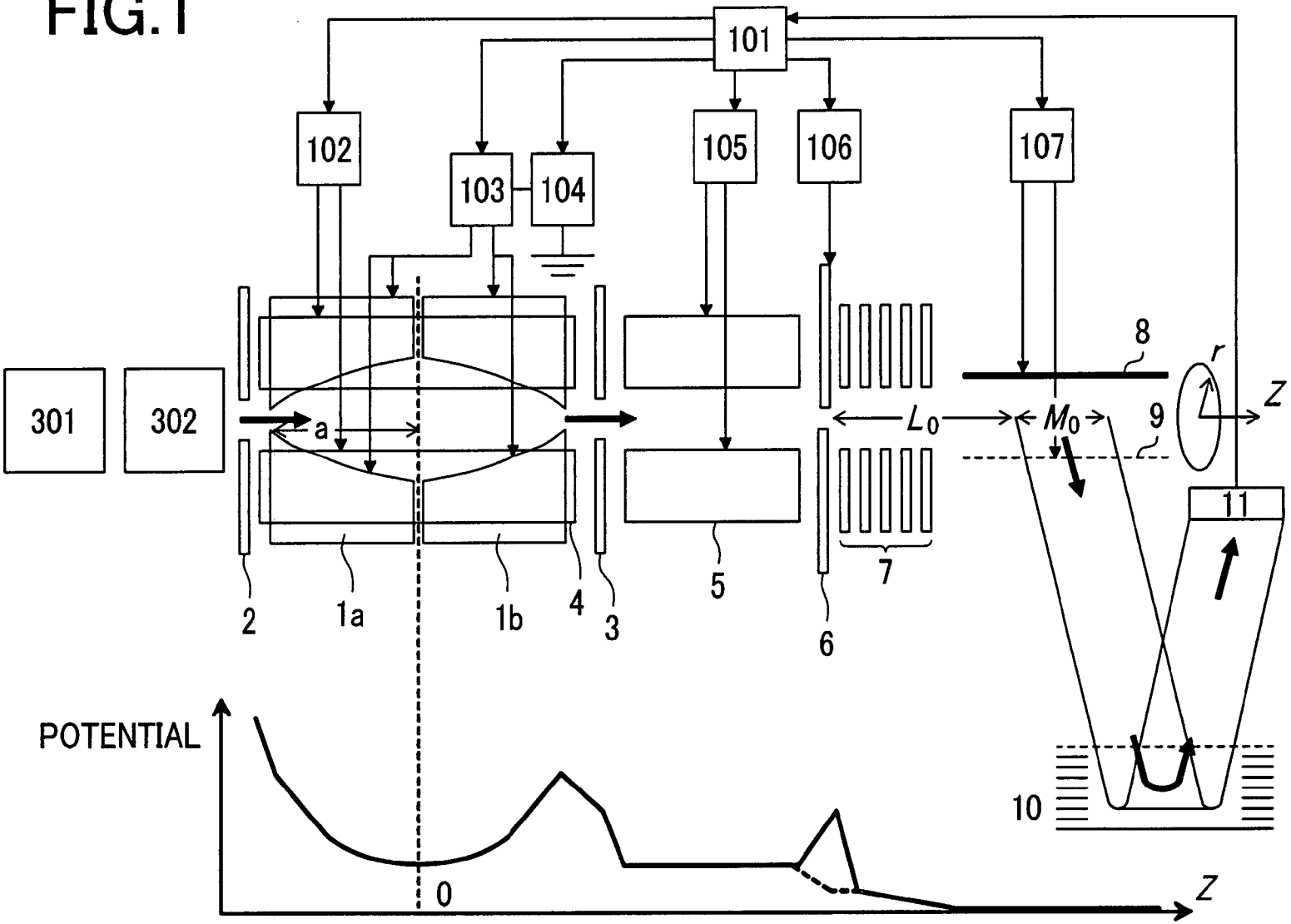
FIG. 1 is a diagram of assistance in explaining the construction of an apparatus according to a first embodiment of the present invention.

FIG. 1 shows a block diagram of a time-of-flight mass spectrometer according to a first embodiment of the present invention. The pumping device such as a pump and the buffer gas introducing mechanism are omitted for simplification.

Ions generated by an ionization source 301 such as an electrospray ionization source, a matrix assisted laser desorption ionization source, an atmospheric pressure chemical ionization source, an atmospheric pressure photoionization source, or an atmospheric pressure matrix assisted laser desorption ionization source are introduced via an ion transfer optics 302 having an octapole, a quadrupole mass filter, or a quadrupole ion trap or a multipole linear trap permitting accumulation, isolation, and dissociation and an inlet electrode 2 into a first linear trap. The detail of the first linear trap is described in the previously described Conventional Method (Patent Document 3).

Figure 16:
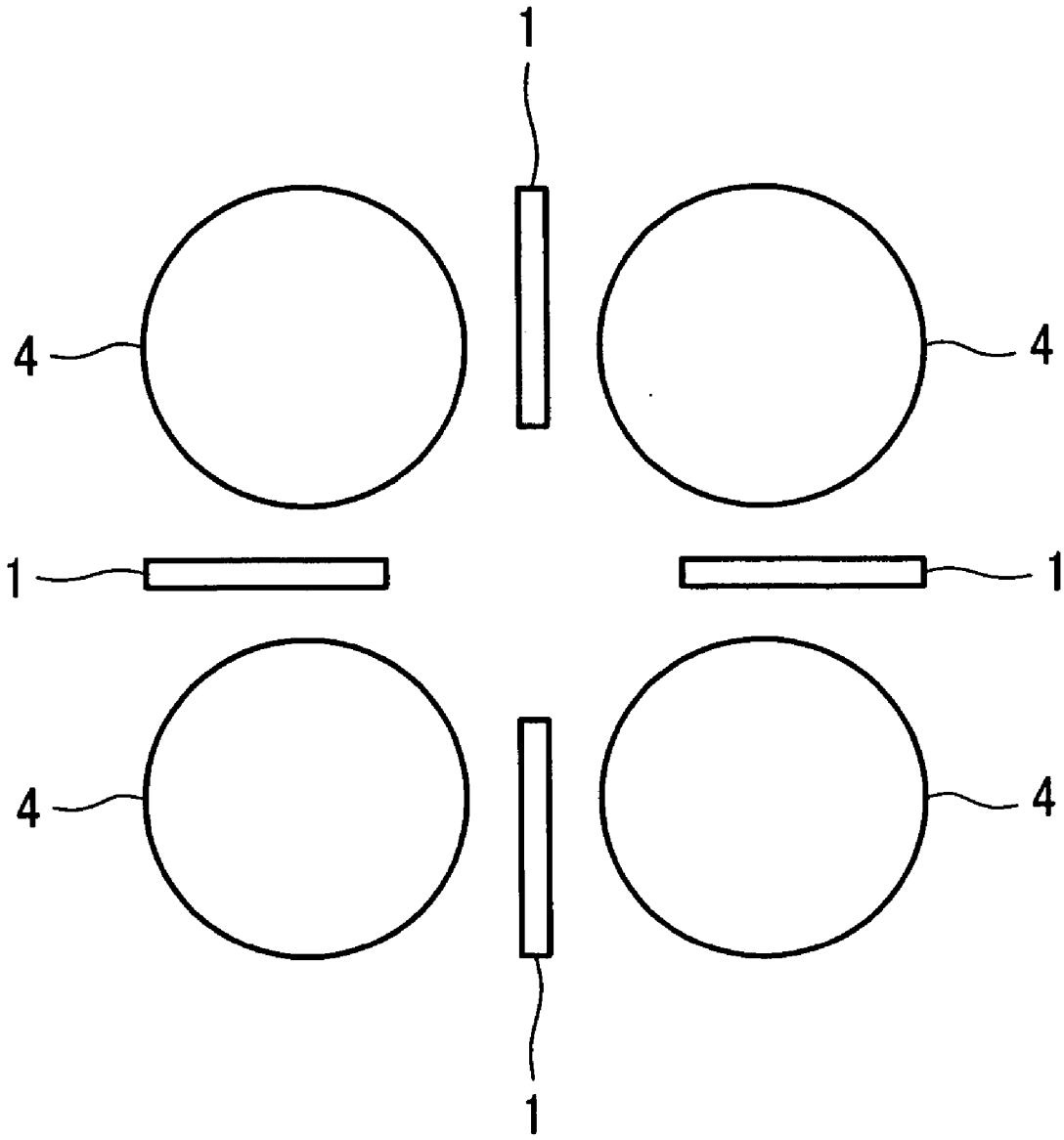
FIG. 16 is a diagram of assistance in explaining the arrangement construction of quadrupole rods and vane electrodes according to the first embodiment.

The first linear trap has an inlet electrode 2, an end electrode 3, four, six or eight multipole rods 4 (in this example, quadrupole rods are shown), and vane electrodes 1*a* and 1*b* divided into two on Z axis inserted between them. FIG. 16 shows a constructional example in which the vane electrodes 1 are inserted between the quadrupole rods 4. In the drawing, the vane electrodes 1 are provided between all the quadrupole rods 4. Two vane electrodes provided between a pair of quadrupole rods 4 opposite each other enables such potential formation. The vane electrodes 1 are divided into two or more (in this example, two vane electrodes 1*a* and 1*b* are shown) in the Z axis direction.

An RF voltage whose phase is inverted alternately generated by an RF power supply 102 is applied to the quadrupole rods 4. The typical voltage amplitude of the RF voltage is some hundreds of volts to several kilovolts and the frequency is about 500 kHz to 2 MHz. A gas is supplied so that the typical gas pressure in this space is 0.02 to 10 Pa (for He) or 0.006 to 3 Pa (for argon Ar, air, nitrogen $N_2$, or a mixed gas of them), not shown.

The ions introduced by the ion transfer optics 302 into the part collide with the gas to lose kinetic energy and are cooled to the almost thermal energy state (0.025 eV) to be trapped in the center part.

A DC voltage (about 5 to 30 V) is applied by a DC bias power supply 104 between the inserted vane electrodes 1 and the rods 4. With the DC voltage application, a harmonic potential can be formed in the Z axis direction above the space surrounded by the rods 4 and the vane electrodes 1 (see the potential diagram on the lower side of FIG. 1). The magnitude of the harmonic potential formed on the axis is $D_0$. The Z axis origin is placed on the minimum point (0) of the harmonic potential. The distance from the minimum point to the end is a. The potential D(Z) in the axial direction in the distance Z from the minimum point of the harmonic potential is approximated by the following equation (1).

$$D(Z) \approx D_0\left(\frac{Z}{a}\right)^2 \tag{1}$$

An AC voltage generated by the supplemental AC power supply is applied between the vane electrodes 1*a* and 1*b*. The voltage having a typical voltage amplitude of 0.3 to 3 V, a single frequency of about 1 to 1000 kHz, or a superimposing of them is applied. The selection of these frequencies will be described below. The kinetic equation in the Z axis direction is expressed by the following equation (2).

$$m\frac{d^2Z}{dt^2} = -2neD_0\frac{Z}{a^2} \tag{2}$$

where m is an ion mass, e is an electron quantum, and n is the number of charges.

From the above, resonant frequency f in the Z axis direction is expressed by the following equation (3).

$$f = \frac{1}{2\pi}\sqrt{\frac{2neD_0}{ma^2}} \tag{3}$$

When $D_0$=10 eV and a=25 mm, f is expressed by the following equation (4).

$$f = 2.8 \times 10^5 \times \frac{1}{\sqrt{M}} \tag{4}$$

where m is a mass.

Figure 2:
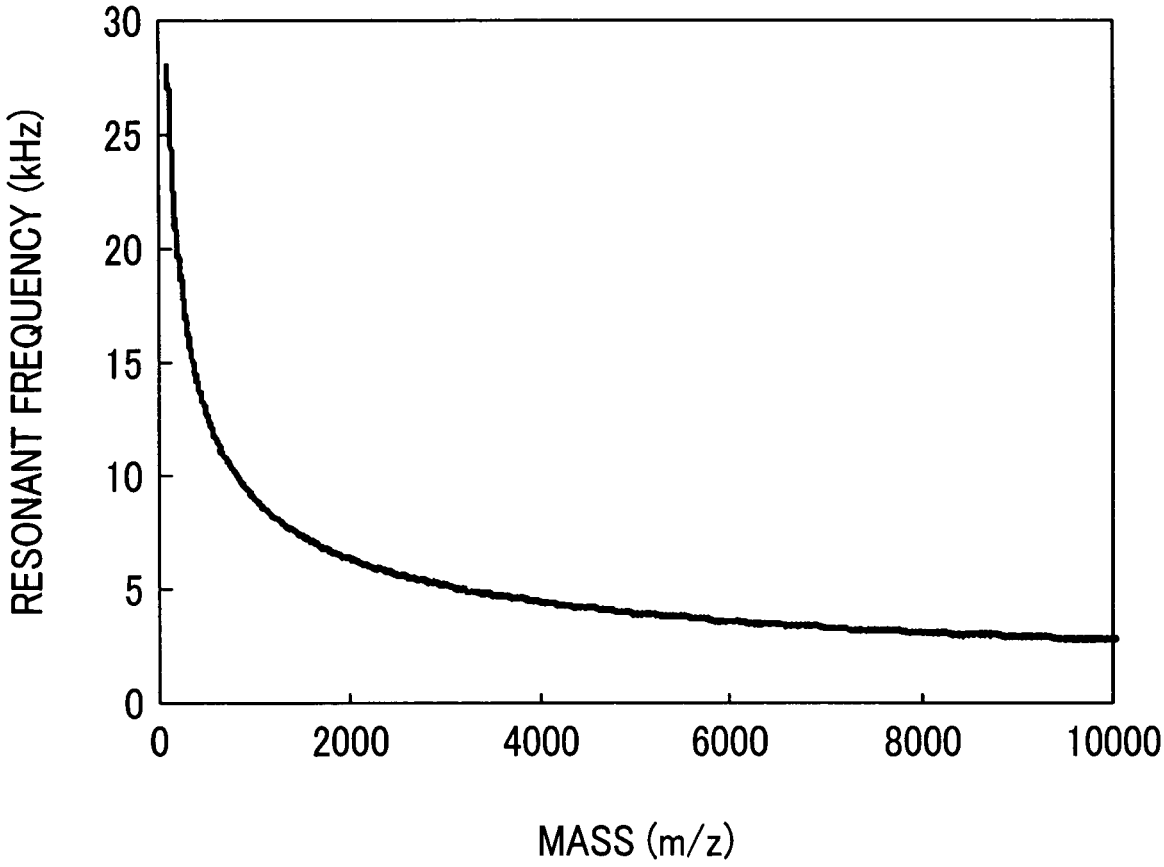
FIG. 2 is a diagram of assistance in explaining the relation between ejected mass and resonant frequency according to the first embodiment.

FIG. 2 shows the relation between ejected mass and resonant frequency. The resonant frequency is decreased to be inversely proportional to the square root of mass. Application of a resonant voltage excites ions having a resonant mass in the axial direction. The ions are beyond the harmonic potential within 1 ms to be ejected to the outside. In this case, the ions not affected by resonance are continuously accumulated to near the center. When the potential of the inlet electrode 2 is set to about several volts higher than the end electrode 3, the ions are ejected almost 100% in the direction of the end electrode 3.

The second linear trap has four, six or eight multipole rods 5 and an end lens 6. An RF voltage whose phase is inverted alternately generated by an RF power supply 105 is applied to the rods 5. The typical voltage amplitude of the RF voltage is some hundreds of volts to several kilovolts and the frequency is about 500 kHz to 2 MHz. A gas is supplied so that the typical gas pressure in this space is 4 to 20 Pa (for He) or 0.5 to 3 Pa (for Ar and $N_2$), not shown. In the second linear trap, the ions ejected from the first linear trap collide with the gas to lose kinetic energy and are cooled to the almost thermal energy state (0.25 eV). The exit portion of the second linear trap has the end lens 6. The voltage is controlled by a power supply for the end lens 106. The potential of the end lens 6 is increased and decreased from the potential on the center axis of the rods 5 to accumulate and eject the ions (see the potential diagram on the lower side of FIG. 1). In the case of positive ions, the potential of the end lens is set to several volts higher than the potential on the center axis (solid line) to permit accumulation. When it is set to several volts lower than that (dotted line), the ions pass through the narrow hole of the end lens 6 to be introduced into the TOF part. In the case of negative ion measurement, the polarity may be inverted. The voltage of the end lens is generated by the power supply for the end lens 106.

The ions introduced into the TOF part are focused by ion lenses 7 composed of a plurality of electrodes. The ions are introduced into the accelerator of the time-of-flight mass spectrometer having a push electrode 8 and a pull electrode 9. A power supply for accelerator 107 applies a voltage of some hundreds of volts to several kilovolts between the push electrode 8 and the pull electrode 9. The ions are accelerated in the direction orthogonal to the ion introduction direction. The timing of accelerating voltage application is synchronized with the timing of ejection of the end lens 5 in the later-described relation. The ions accelerated in the orthogonal direction reach the detector as they are, not shown, or are deflected via a reflection lens called a reflectron 10 to reach a detector 11 having an MCP. Ion mass can be measured based on the relation between the acceleration start time of the accelerator and the ejection time. The reaching ions are subject to amplification and summation to be accumulated in a controller 101.

In this embodiment, the controller 101 controls a supplemental AC power supply 103, the power supply for the end lens 106, and the power supply for accelerator 107 to permit highly sensitive detection in a wide mass range. Specific control parameters will be described below using FIGS. 3 to 6.

Figure 3:
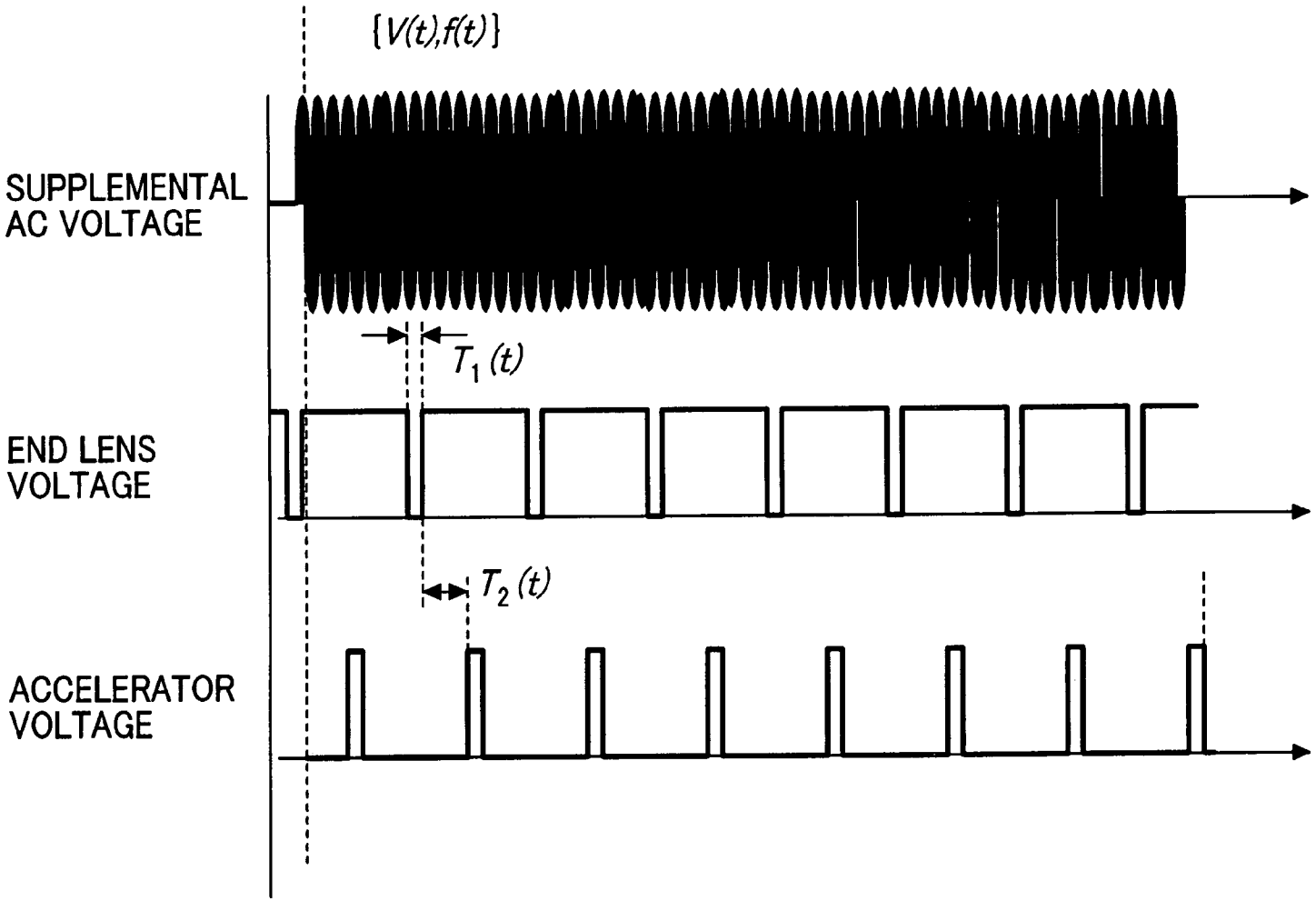
FIG. 3 is a diagram of assistance in explaining a measurement sequence according to the first embodiment.

FIG. 3 shows a measurement sequence. In the drawing, a supplemental AC voltage applied between the vane electrodes 1*a* and 1*b*, an end lens voltage applied to the end lens 6 of the second linear trap, and an accelerator voltage applied to the push electrode 8 and the pull electrode 9 are shown. Amplitude V(t) of the supplemental AC voltage, frequency f(t), the time duration of the ions $T_1$ in which the ions are ejected from the second linear trap, or delay time $T_2$ from the completion of ejection to application of an accelerating voltage of the time-of-flight mass spectrometer is changed with time. A specific example of these values is shown below.

Figure 4:
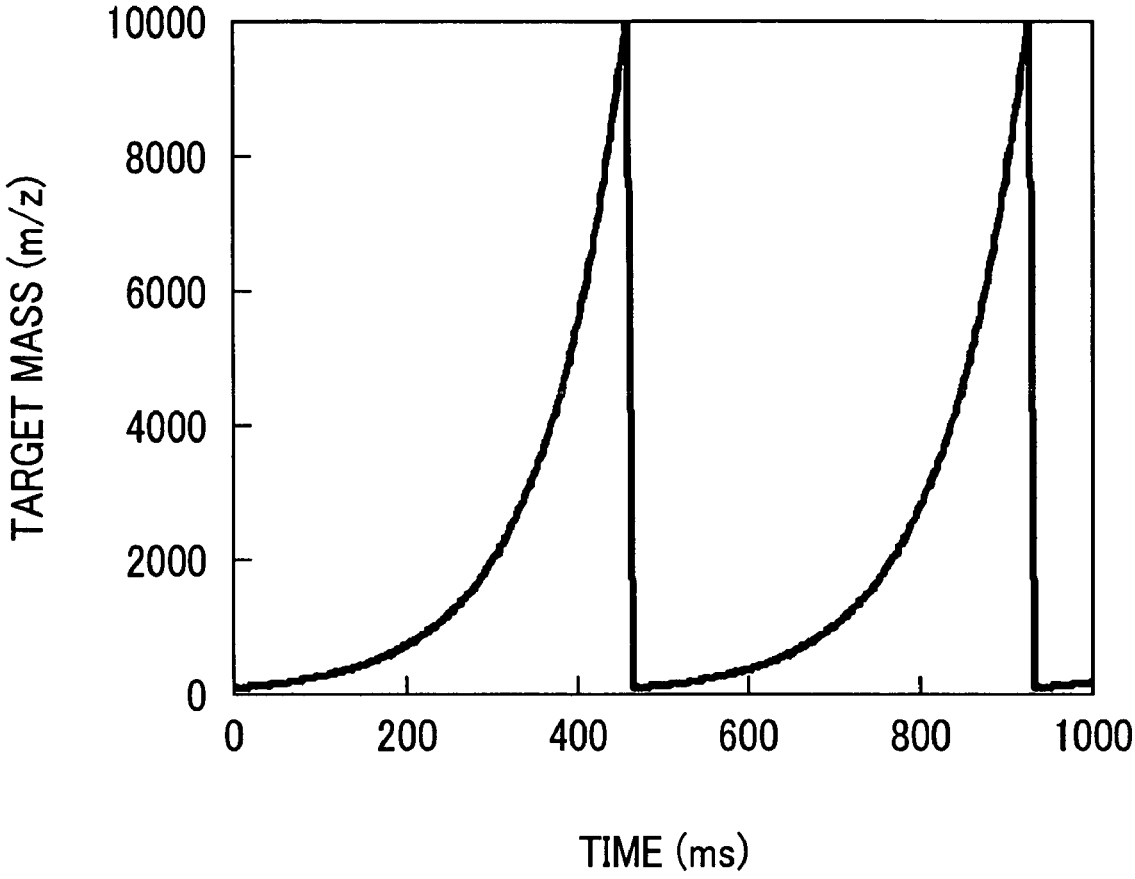
FIG. 4 is a diagram of assistance in explaining effect (1) according to the first embodiment.

FIG. 4 shows target mass in time for measuring a mass of 100 to 10000. The horizontal axis indicates time and the vertical axis indicates measured target mass. In this example, about 460 ms is required for one measurement. This is the case of performing setting so that the mass resolution of ions ejected from the first linear trap is 100 (M/ΔM), that is, ion measurement of a mass region (1M to 1.01M) is performed within 1 ms. The target mass is increased with time to reach a mass of 10000, and is then retuned to a mass of 100. This operation is repeated.

Figure 5:
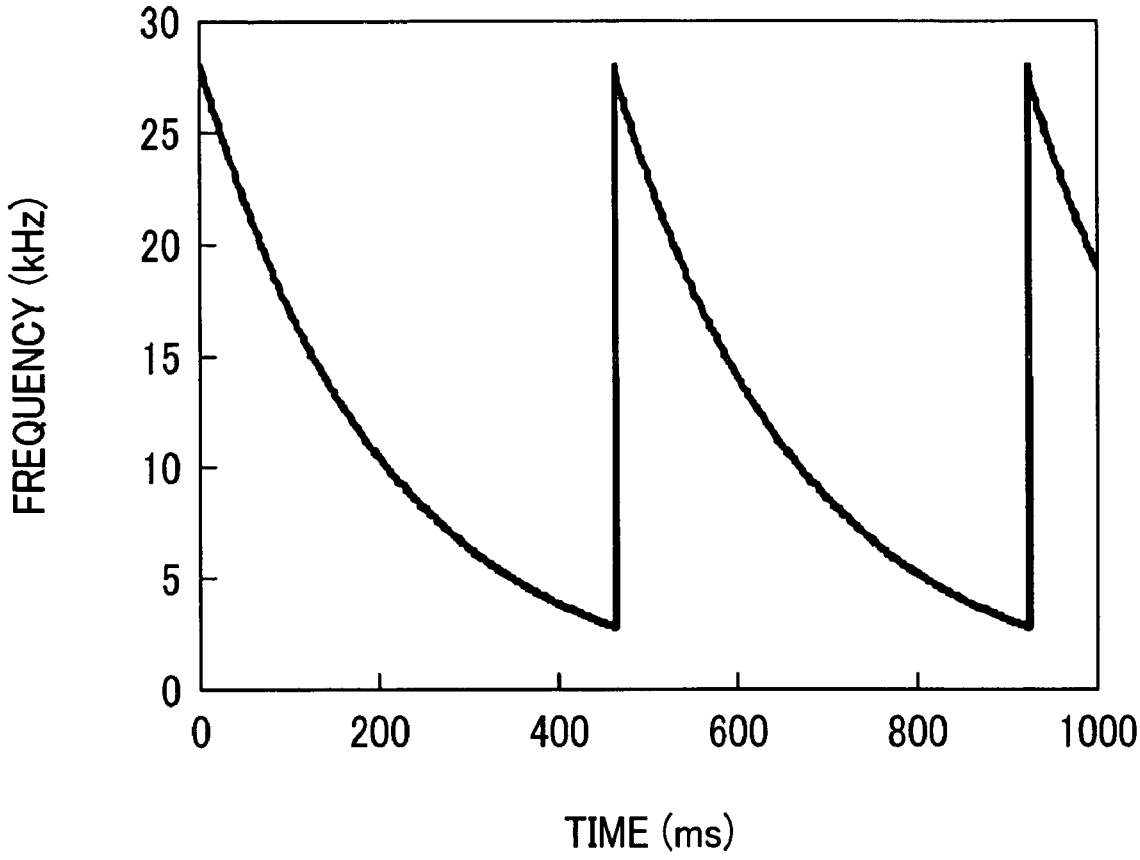
FIG. 5 is a diagram of assistance in explaining effect (2) according to the first embodiment.

FIG. 5 shows the frequency of the supplemental AC voltage for ejecting ions in the mass region of FIG. 4 from the first trap to the second trap. The larger the target mass, the frequency is lowered from the previously described equation (4) relation. The amplitude value of the supplemental AC voltage largely depends on gas pressure, the size of the apparatus, potential, scan speed, and target mass, and is typically about 0.3 to 3 V.

Figure 6:
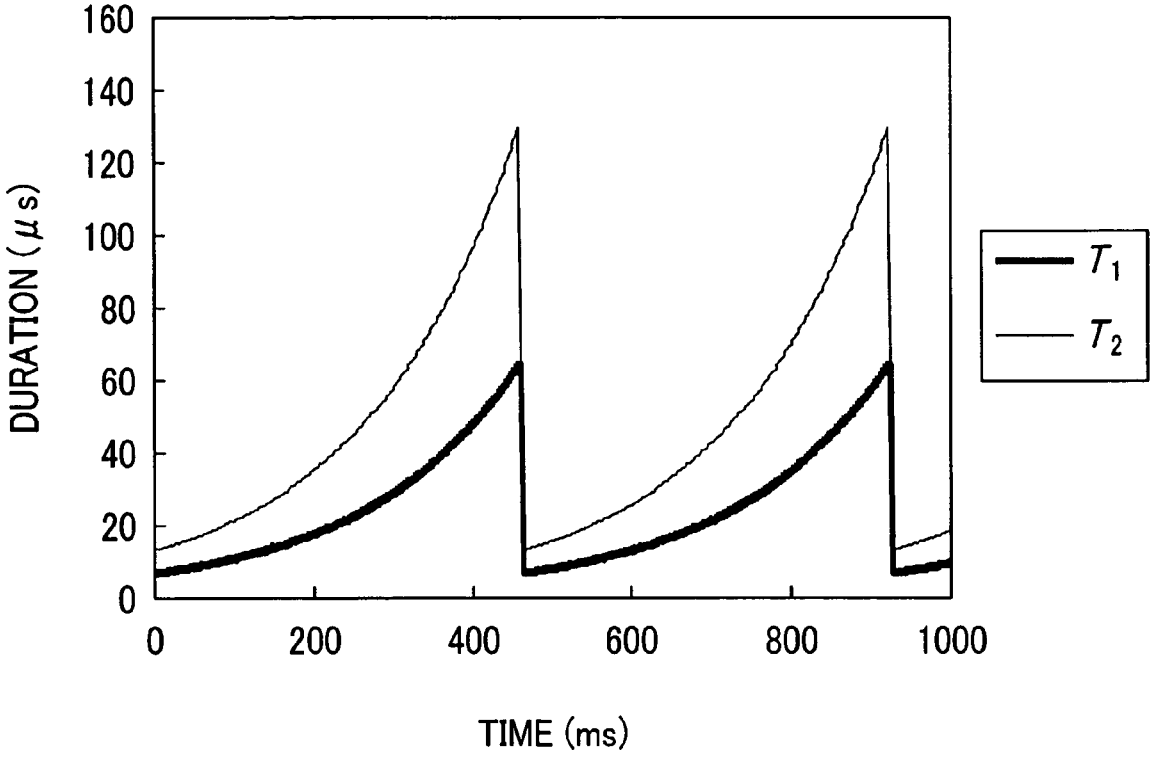
FIG. 6 is a diagram of assistance in explaining effect (3) according to the first embodiment.

FIG. 6 shows the set values of $T_1$ and $T_2$ in each time. In this example, the distance from the end lens 6 to the accelerator region is $L_0$=40 mm, the effective acceleration region is $M_0$=20 mm, the incident energy is 5 eV, and $T_2=2T_1$.

Figure 7:
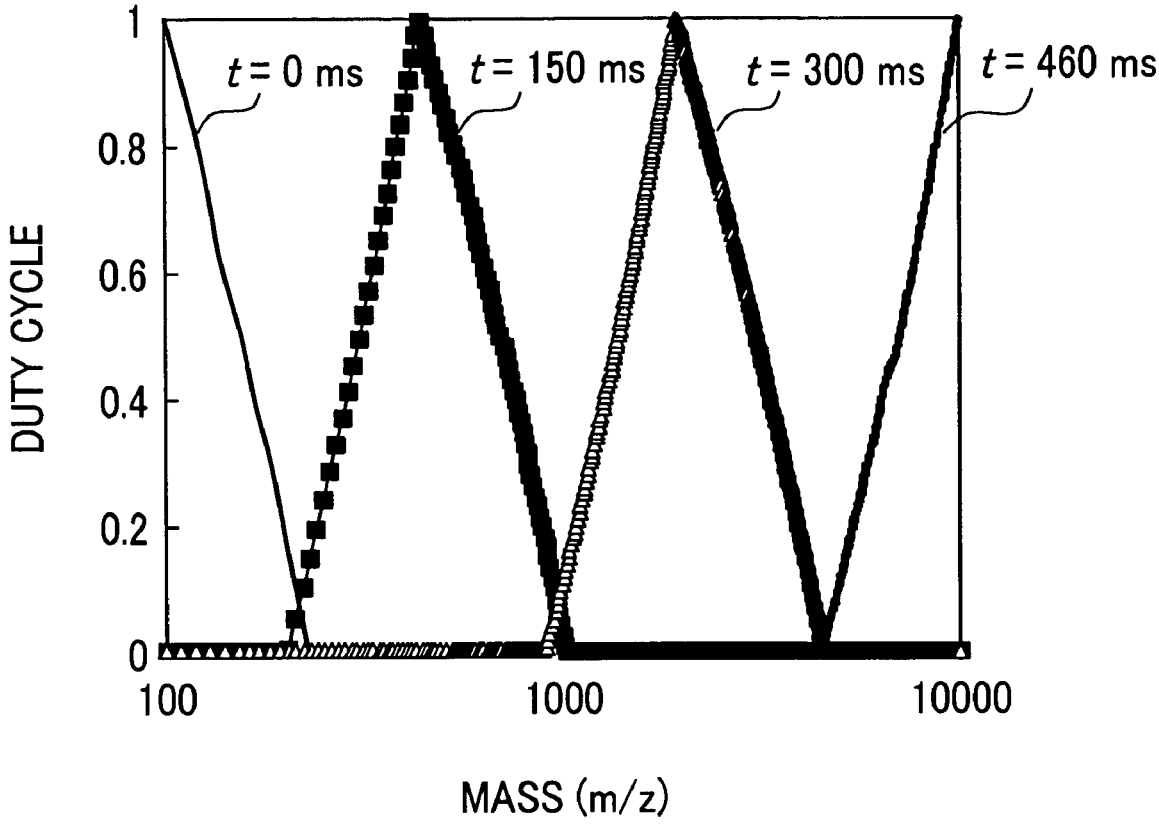
FIG. 7 is a diagram of assistance in explaining effect (4) according to the first embodiment.

FIG. 7 shows the mass dependence of the duty cycle in three times (t=0 ms, 150, 300, 460 ms). $T_1$ and $T_2$ are set to different values to obtain a high duty cycle in different mass ranges. Ejection time in which ions ejected from the first trap are ejected from the second trap to the TOF part is about 0 to 10 ms. The ions exist in the second trap in a range of substantially 1M to 1.1M. At this time, when $T_1$ and $T_2$ are set so that near 1.05M is the maximum duty cycle, the duty cycle is 90% or above. In a series of measurement, $T_1$ and $T_2$ are changed according to the previous-stage resonant frequency. A high duty cycle can be obtained in a wide mass range of a mass of 100 to 10000.

Figure 8:
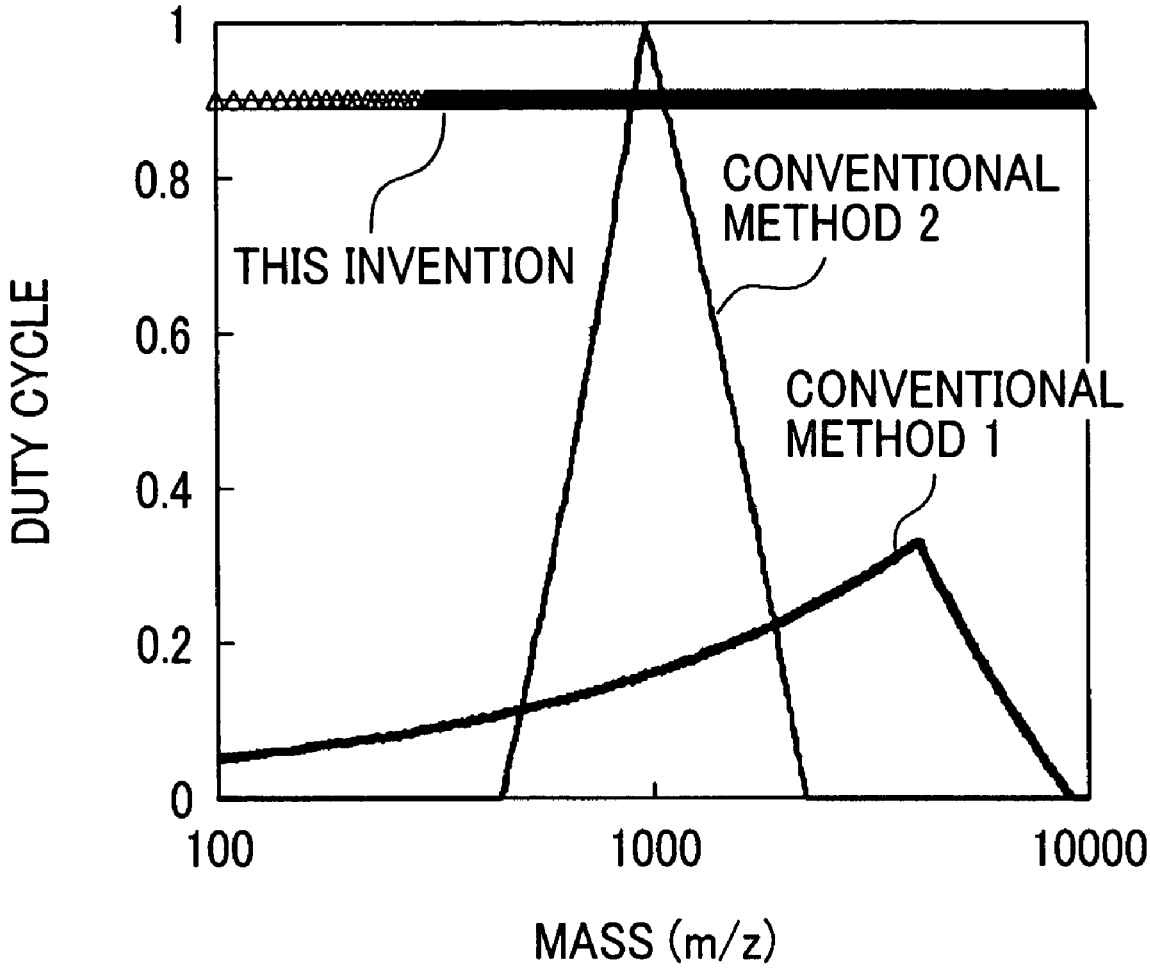
FIG. 8 is a diagram of assistance in explaining effect (5) according to the first embodiment.

FIG. 8 shows duty cycles with a mass of 100 to 10000 in the method of this embodiment and the methods of the above-described Conventional Method 1 (Non-Patent Document 1) and Conventional Method 2 (Patent Document 1). They are results obtained by calculating with $L_0$=40 mm, $M_0$=20 mm, and $T_2=2T_1$ (Conventional Method 2 and this embodiment).

Conventional Method 1 obtains a duty cycle of 5 to 33% with a mass of 100 to 7000. When the accelerating period is set to faster, this distribution can be shifted to the low mass side in principle. In particular, when using the TOF of the reflectron type, the flight time in the TOF part is longer. Overlap on the spectrum is a problem. Conventional Method 2 has the duty cycle when setting $T_1$=20 μs and $T_2$=40 μs so that the duty cycle with a mass of 1000 is maximum. A high duty cycle of 80% or above can be obtained with a mass of 840 to 1170. Ions having a mass of 100 to 430 or 2380 to 10000 cannot be detected at all. Setting of ejection time ($T_1$ and $T_2$) can move in parallel the distribution and slightly change the distribution. Either the mass range or the duty cycle is selected.

When using this embodiment, ions are accumulated in the first trap. Only the ions in a certain mass range are transferred to the second trap. $T_1$ and $T_2$ suitable for their mass range are set to make TOF measurement. The mass range of the ions sequentially ejected from the first trap to the second trap is changed to set $T_1$ and $T_2$ according to this. In a series of measurement, the duty cycle of this embodiment can reach a high duty cycle of 90% or above in a wide mass range having a mass of 100 to 10000.

(Embodiment 2)

The ion quantity which can be accumulated in the first linear trap is limited. In order not to be affected by space charge, faster measurement is desired.

A second embodiment of the present invention making measurement faster will be described. The construction of the apparatus is almost the same as the first embodiment (FIG. 1). A supplemental AC power supply 103 can generate the superimposed waveform of a plurality of RF voltages.

Figure 9:
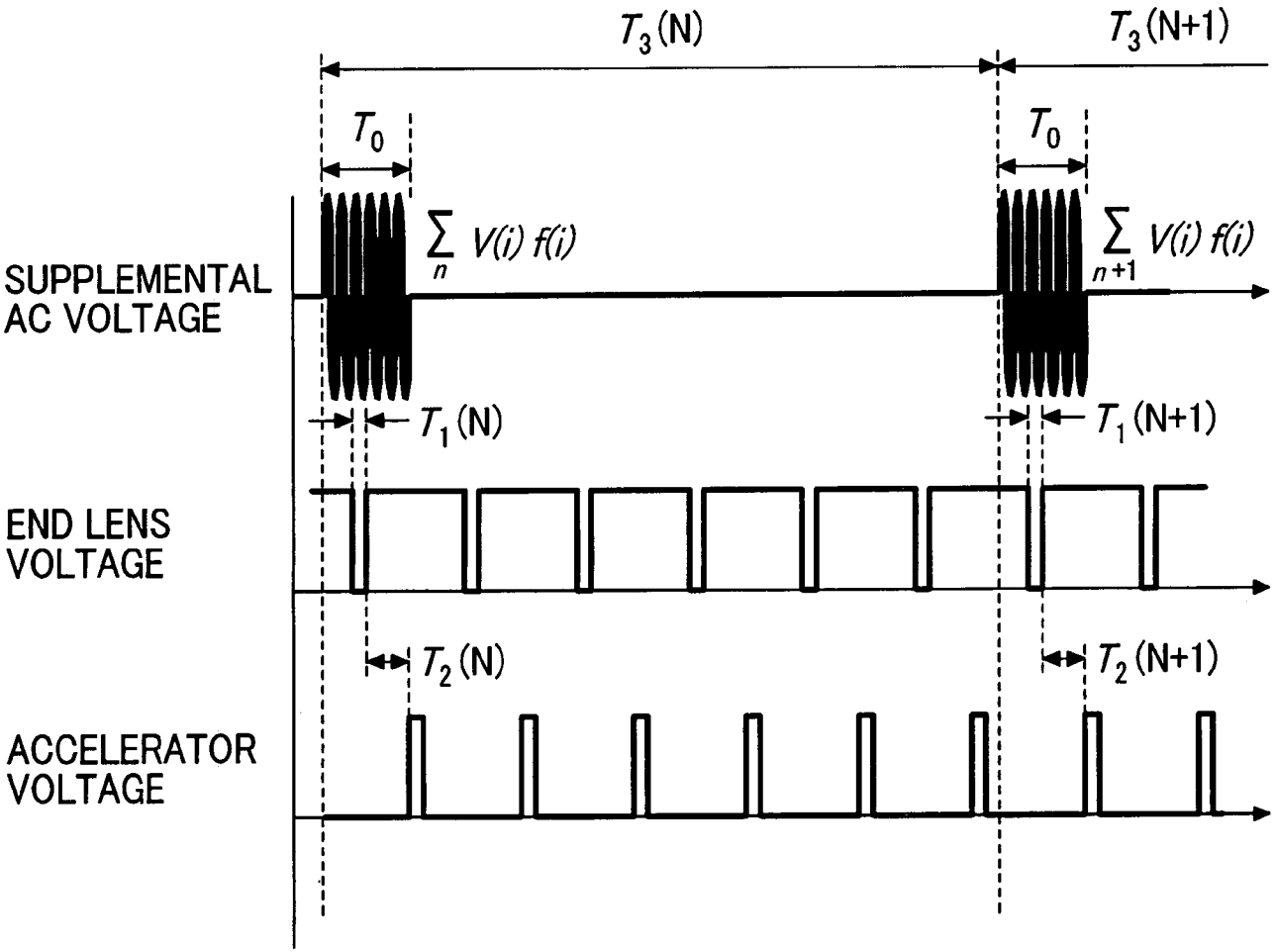
FIG. 9 is a diagram of assistance in explaining a measurement sequence according to a second embodiment of the present invention.

FIG. 9 shows its measurement sequence. The later-described supplemental AC voltage is applied between vane electrodes 1*a* and 1*b* during $T_0$. Only ions in the specific mass range are transferred from the first linear trap to the second linear trap. $T_1$ and $T_2$ are fixed during certain fixed time $T_3$ (about 10 ms) from the start of measurement for detection. Time $T_3$ setting the fixed $T_1$ and $T_2$ is defined as one scan for performing plural scans.

Figure 10:
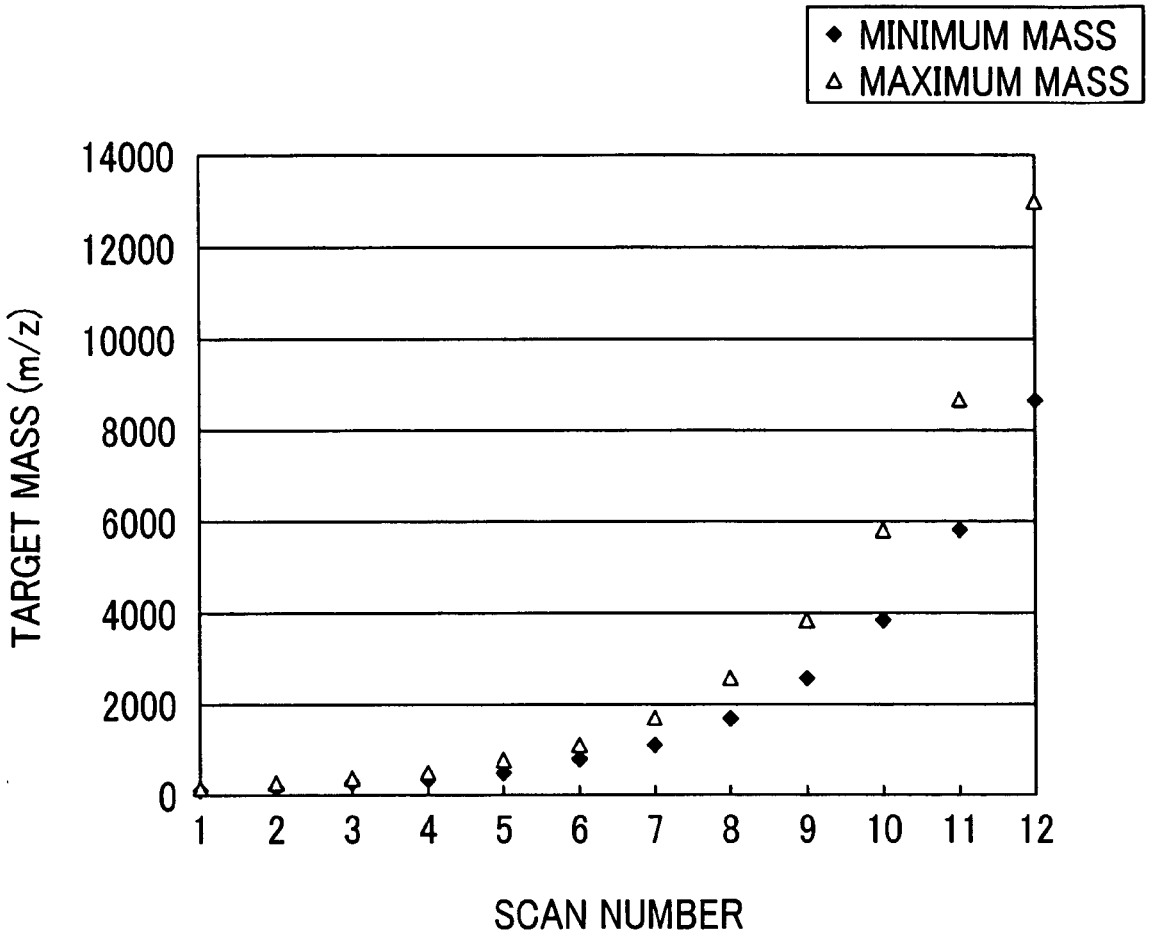
FIG. 10 is a diagram of assistance in explaining effect (1) according to the second embodiment.

FIG. 10 shows target maximum mass and target minimum mass in each scan for measuring ions of 1M to 1.2M by one scan. When measuring the ions of 1M to 1.2M by one scan, 12 scans are required for measuring a mass of 100 to 10000. In each scan, about 10 ms as the passage time in the second linear trap is suitable. One measurement is completed at 120 ms. Measurement faster than the first embodiment is possible.

Figure 11:
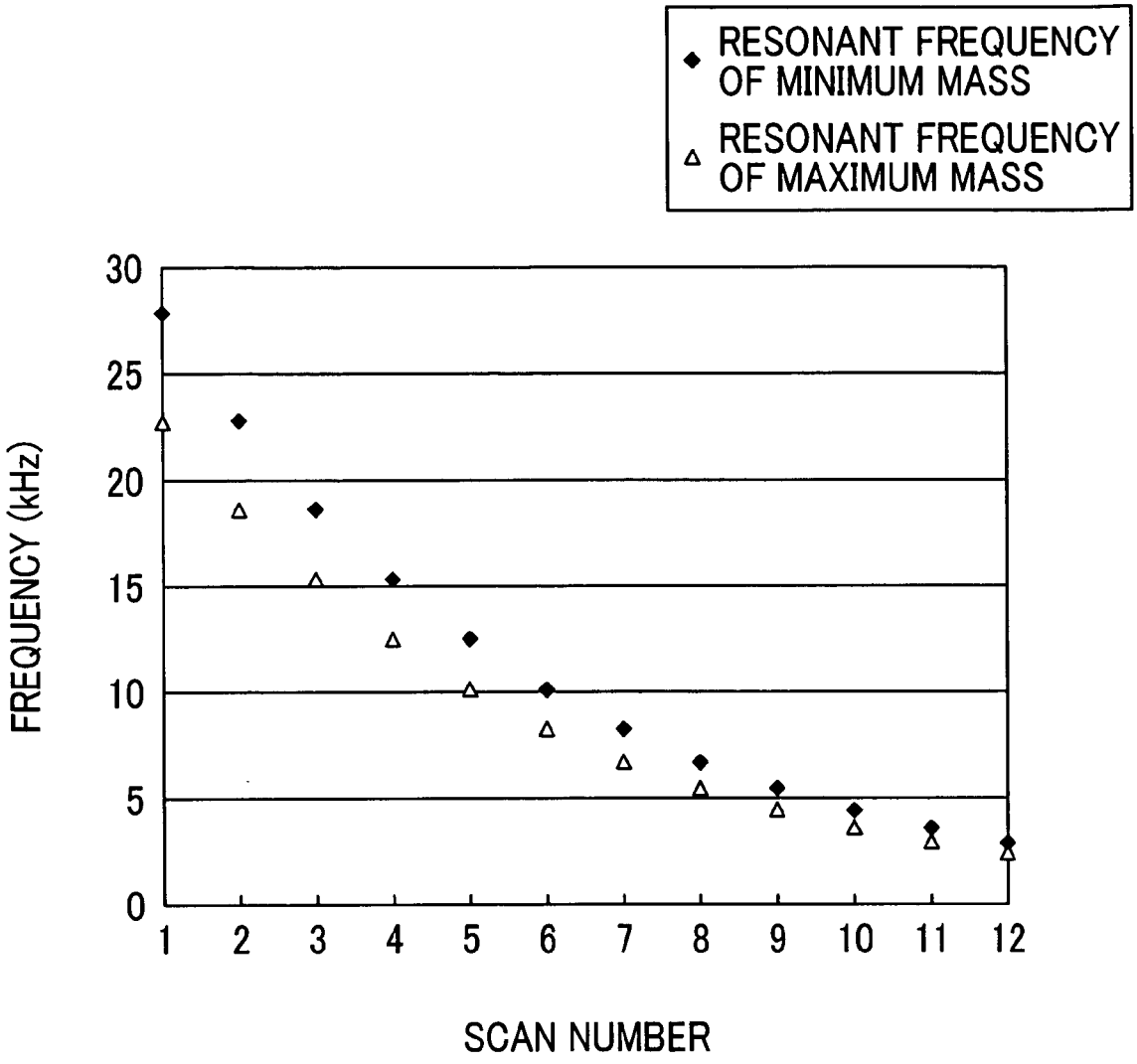
FIG. 11 is a diagram of assistance in explaining effect (2) according to the second embodiment.

FIG. 11 shows maximum values (resonant frequency of minimum mass) and minimum values (resonant frequency of maximum mass) of frequency applied in each scan. The superimposed waveforms can be synthesized with each other by inverse Fourier transform of RF voltage at 0.1 to 0.5-kHz intervals. In reality, the synthesized waveforms are stored in the memory of the supplemental AC power supply 103, which permits fast calling.

Figure 12:
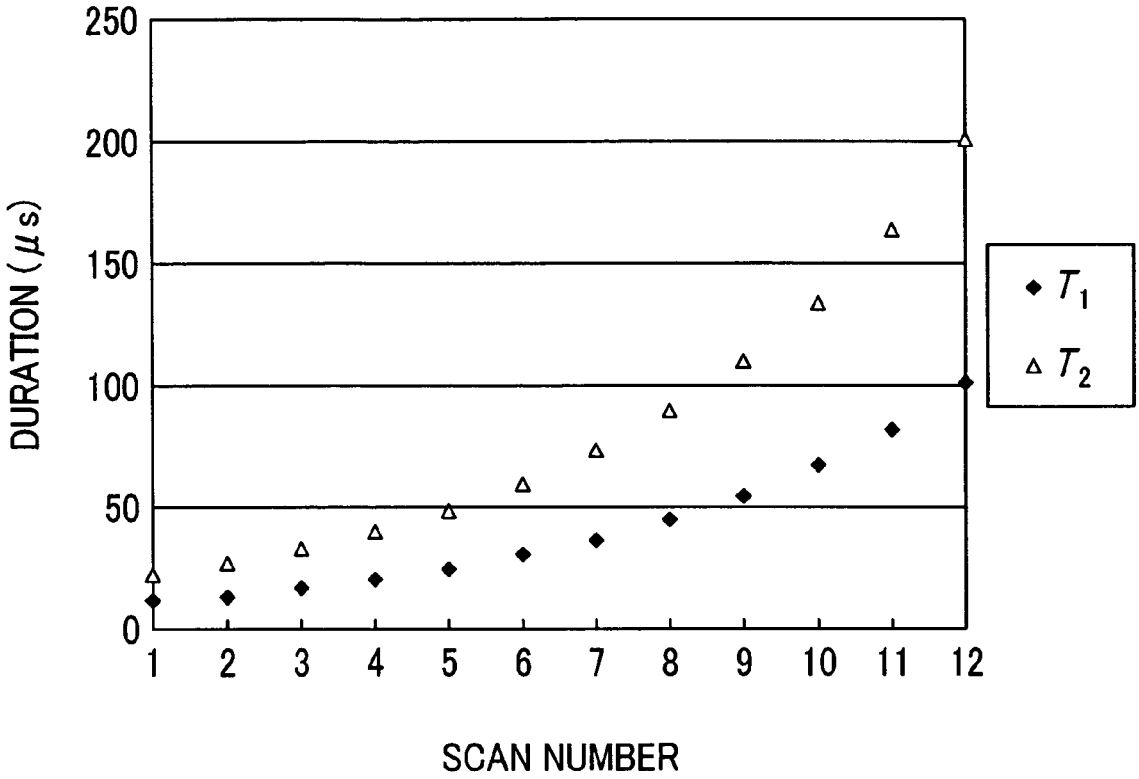
FIG. 12 is a diagram of assistance in explaining effect (3) according to the second embodiment.

FIG. 12 shows the setting values of $T_1$ and $T_2$ in each scan. They are set so that the duty cycle of the center value (1.1M) of the mass to be measured is maximum. Using this embodiment, ions having a mass of 100 to 10000 can be measured in time shorter than Embodiment 1 at a duty cycle of 90% or above. In this embodiment, one scan is formed in the range of 1M to 1.2M. This mass range can be increased to make the measurement faster. In this case, however, the duty cycle is lower.

(Embodiment 3)

Figure 13:
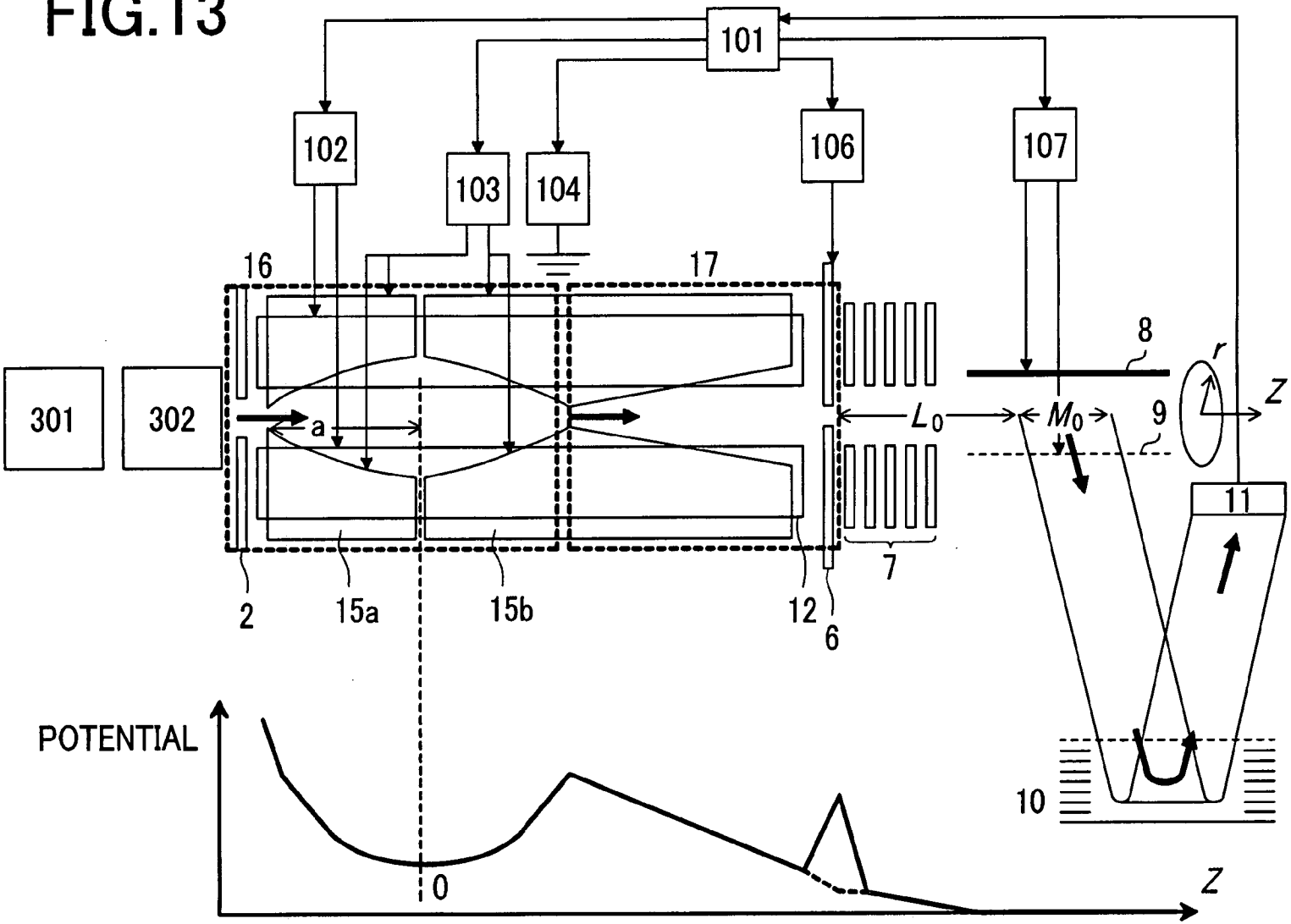
FIG. 13 is a diagram of assistance in explaining the construction of an apparatus according to a third embodiment of the present invention.

Embodiment 3 of the present invention will be described using FIG. 13. In this embodiment, a first linear trap 16 and a second linear trap 17 use the same multipole rods 12 to make the apparatus simplifier and the cost lower. In FIG. 13, the pumping device such as a pump and the buffer gas introduction mechanism are omitted for simplification.

Ions generated by an ionization source 301 such as an electrospray ionization source, an atmospheric pressure chemical ionization source, an atmospheric pressure photoionization source, or an atmospheric pressure matrix assisted laser desorption ionization source are introduced via an ion transfer optics 302 having an octapole, a quadrupole mass filter, or a multipole linear trap and an inlet electrode 2 into a first linear trap 16. The first linear trap 16 has the inlet electrode 2, four, six or eight multipole rods 12 (in this example, quadrupole rods are shown), and part of the region surrounded by vane electrodes 15*a* and 15*b* divided into two on the axis inserted between them. As described in the Embodiment 1, the vane electrodes 15*a* and 15*b* are inserted between the quadrupole rods 12. The vane electrodes 15*a* and 15*b* may be provided between all the quadrupole rods 12 or may be provided between a pair of quadrupole rods 12 opposite each other. The vane electrodes 15 are divided into two or more (in this example, two vane electrodes 15*a* and 15*b* are shown) in the Z axis direction.

An RF voltage whose phase is inverted alternately generated by an RF power supply 102 is applied to the quadrupole rods 12. The typical voltage amplitude of the RF voltage is some hundreds of volts to several kilovolts and the frequency is about 500 kHz to 2 MHz. A gas is supplied so that the typical gas pressure of the first linear trap 16 and the second linear trap 17 is 1 to 10 Pa (for He) or 0.3 to 3 Pa (for Ar or $N_2$), not shown. The ions introduced by the ion transfer optics 302 into the part collide with the gas to lose kinetic energy and are cooled to the almost thermal energy state (0.25 eV) to be trapped in the center part. A DC voltage (about 5 to 30 V) is applied by a DC bias power supply 104 between the inserted vane electrodes 15 and the rods 12. With the DC voltage application, a harmonic potential can be formed in the Z axis direction above the space surrounded by the rods 4 and the vane electrodes 1 (see the potential diagram on the lower side of FIG. 13). Application of a resonant voltage of a supplemental AC power supply 103 excites ions having resonant mass in the axial direction. The ions are beyond the harmonic potential within 1 ms to be ejected to the second linear trap 17. In this case, the ions not affected by resonance are continuously accumulated near the center. When the potential of the inlet electrode 2 is set to about several volts higher than the potential of the exit portion of the first linear trap 16, the ions are ejected almost 100% in the direction of the second linear trap 17.

The second linear trap 17 has four, six or eight multipole rods 12, part of the vane electrode 15*b*, and an end lens 6. In the second linear trap, the ions ejected from the first lineartrap collide with the gas to lose kinetic energy and are cooled to the almost thermal energy state (0.25 eV). An accelerating potential is formed in the axial direction on the center axis of the second linear trap. The ions can be efficiently transferred near the end lens 6. The exit portion of the second linear trap has the end lens 6. The voltage is controlled by a power supply for the end lens 106. The potential of the end lens 6 is increased and decreased from the potential on the center axis of the rod 5 to accumulate and eject the ions (see the potential diagram on the lower side of FIG. 13). In the case of positive ions, the potential of the end lens is set to several volts higher than the potential on the center axis (solid line) to permit accumulation. When it is set to several volts lower than that (dotted line), the ions pass through the narrow hole of the end lens 6 to be introduced into the TOF part. In the case of negative ion measurement, the polarity may be inverted. The voltage of the end lens is generated by a power supply for the end lens 106.

The ions introduced into the TOF part are focused by ion lenses 7 composed of a plurality of electrodes. The ions are introduced into the accelerator of the time-of-flight mass spectrometer having a push electrode 8 and a pull electrode 9. A power supply for accelerator 107 applies a voltage of some hundreds of volts to several kilovolts between the push electrode 8 and the pull electrode 9. The ions are accelerated in the direction orthogonal to the ion introduction direction. The timing of accelerating voltage application is synchronized with the timing of ejection of the end lens 6 in the later-described relation. The ions accelerated in the orthogonal direction reach the detector as they are, not shown, or are deflected via a reflection lens called a reflectron 10 to reach a detector 11 having an MCP. Ion mass can be measured based on the relation between the acceleration start time of the accelerator and the ion detection time. The reaching ions are subject to amplification and summation to be accumulated in a controller 101. In Embodiment 3, the controller 101 controls a supplemental AC power supply 103, the power supply for the end lens 106, and a power supply for accelerator 107 to permit highly sensitive detection in a high mass region. The control parameters and control method are possible by the same method as Embodiments 1 and 2.

(Embodiment 4)

Figure 14:
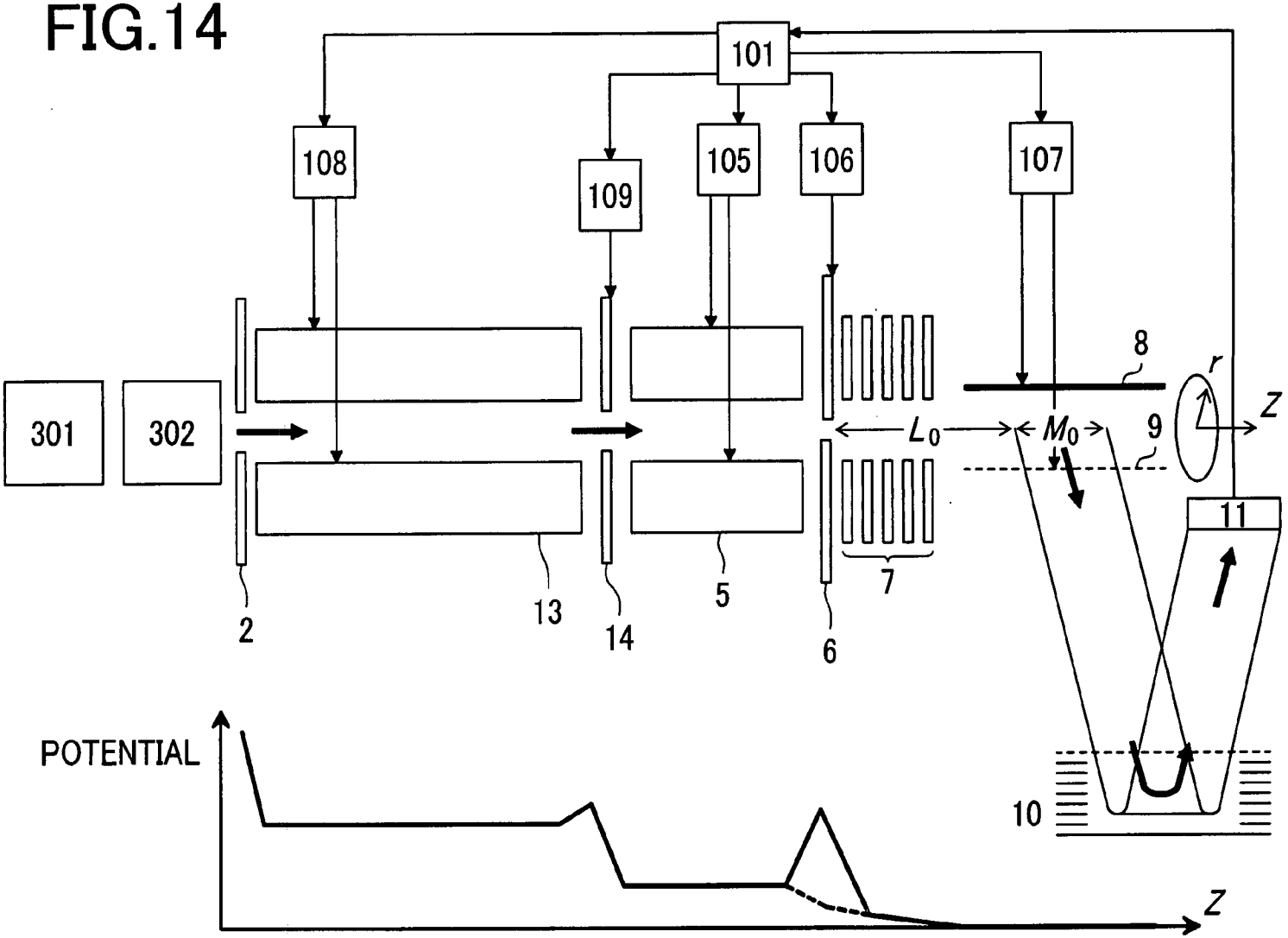
FIG. 14 is a diagram of assistance in explaining the construction of an apparatus according to a fourth embodiment of the present invention.

In the method of the present invention, a similar effect can be obtained by being combined with another method which can mass selectively eject ions from the multipole linear trap. FIG. 14 shows Embodiment 4 of the present invention and is a block diagram of the apparatus when applying the method described in the above-described Conventional Method (Patent Document 4) as the first linear trap. The pumping device such as a pump and the buffer gas introduction mechanism are omitted for simplification.

Ions generated by an ionization source 301 such as an electrospray ionization source, an atmospheric pressure chemical ionization source, an atmospheric pressure photoionization source, or an atmospheric pressure matrix assisted laser desorption ionization source are introduced via an ion transfer optics 302 having an octapole, a quadrupole mass filter, or a multipole linear trap and an inlet electrode 2 into a first linear trap. The first linear trap of this embodiment has four quadrupole rods 13, the end electrode 2, and an end lens 14. An RF voltage whose phase is inverted alternately generated by a power supply 108 is applied to the quadrupole rods 13. The typical voltage amplitude of the RF voltage is some hundreds of volts to several kilovolts and the frequency is about 500 kHz to 2 MHz. The ions ejected by the ion transfer optics 302 in this portion collide with the gas to lose kinetic energy and are cooled to the almost thermal energy state (0.25 eV) to be trapped in the first trap.

Figure 15A:
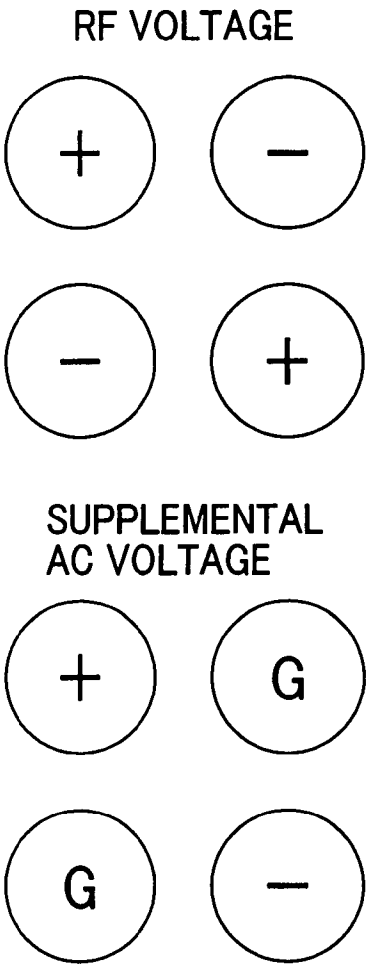
FIG. 15A is a diagram of assistance in explaining voltage application (1) according to the fourth embodiment.
Figure 15B:
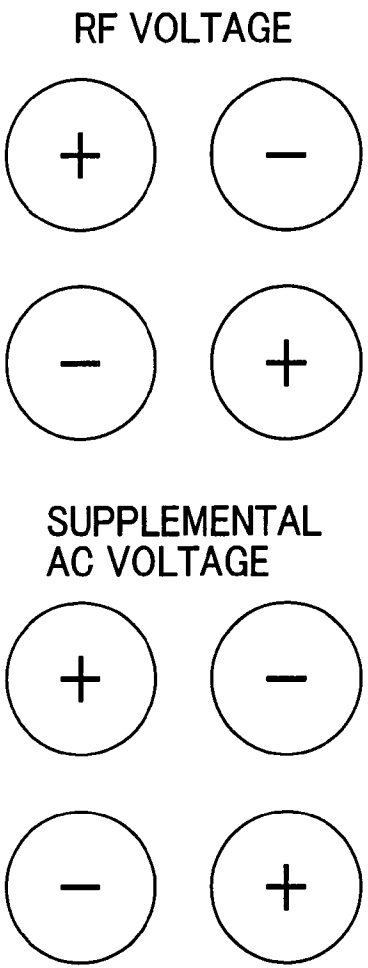
FIG. 15B is a diagram of assistance in explaining voltage application (2) according to the fourth embodiment.
Figure 15C:
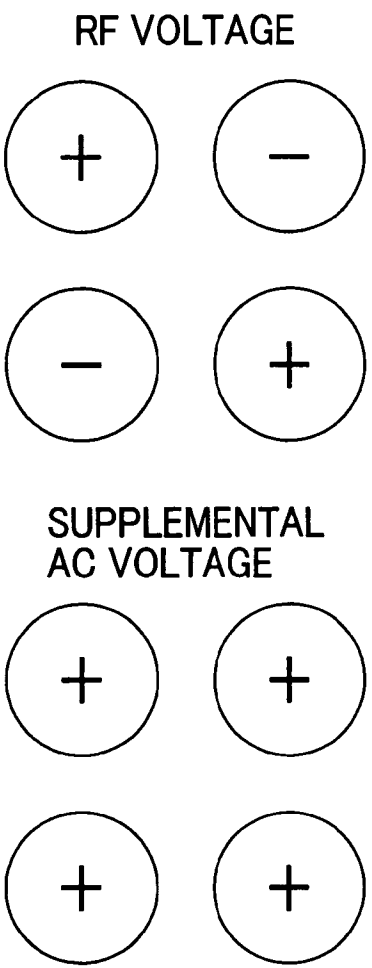
FIG. 15C is a diagram of assistance in explaining voltage application (3) according to the fourth embodiment.

FIGS. 15A to 15C show voltage application methods (three examples) for ejection from the first trap in this embodiment. FIG. 15A shows RF voltage and supplemental AC voltage application when applying a quadrupole resonant voltage between the rods opposite each other (in the drawing, G denotes a ground voltage). FIG. 15B shows RF voltage and supplemental AC voltage application when applying the same octapole resonant voltage of the same phase between the rods opposite each other. FIG. 15C shows RF voltage and supplemental AC voltage application when applying an octapole resonant voltage between the center potentials of the end lens 14 and the quadrupole rod 13. The relation between the resonant frequency and the mass is expressed by the following equation (5) for FIG. 15A and is expressed by the following equation (6) for FIGS. 15B and 15C.

$$f = \frac{\beta(M)}{2} f_0 \quad (5)$$

$$f = \beta(M) f_0 \quad (6)$$

where β (M) is a parameter uniquely determined by mass and RF voltage amplitude. The detail is described in "Practical Aspects of Ion Trap Mass Spectrometry, CRC Press, 1995".

Ions are excited in r direction by resonance to be converted to the kinetic energy in the Z axis and are ejected in the Z axis direction. When the potential of the inlet electrode 2 is set to about several volts higher than the end lens 14, the ions are ejected in the direction of the second trap. In this method, the controller 101 controls the power supply 108, a power supply. for the end lens 106, and a power supply for accelerator 107 to permit highly sensitive detection in a high mass region. The ion detection means, synchronization method, control parameters, and control method after the second trap are possible by the same method as Embodiments 1 and 2.

As described above in detail, according to the present invention, an orthogonal time-of-flight mass spectrometer which can expect increase in a high duty cycle in a wide mass window which has not been possible in all Conventional Methods is obtained. The detector is made smaller to reduce the cost and to increase the mass resolution in the TOF part.

What is claimed is:

1. A mass spectrometer, comprising:

an ionization source for generating ions;

an ion transfer optics for transferring said ions;

a first ion trap for trapping said ions and ejecting a part of the trapped ions with at least two m/z ranges sequentially;

a second ion trap for trapping the ions ejected from said first ion trap and ejecting them in pulse form; and a time-of-flight mass spectrometer for accelerating the ions ejected from said second ion trap in the orthogonal direction to the introduction direction, wherein said first ion trap has four or more multipole rods to which a main RF voltage is applied, and vane electrodes which can form a harmonic potential in an axial direction of said multipole rods, and a supplemental AC voltage is applied to at least one of said vane electrodes for ejecting a part of the trapped ions.

2. A mass spectrometer according to claim 1, wherein said first ion trap and said second ion trap are constructed by the same multipole rods.

3. A mass spectrometer, comprising:

an ionization source for generating ions;

an ion transfer optics for transferring said ions;

a first ion trap for trapping said ions and ejecting a part of the trapped ions with at least two m/z ranges sequentially;

a second ion trap for trapping the ions ejected from said first ion trap and ejecting them in pulse form; and a time-of-flight mass spectrometer for accelerating the ions ejected from said second ion trap in the orthogonal direction to the introduction direction, wherein said first ion trap has four or more multipole rods to which a main RF voltage is applied, and vane electrodes which can form a harmonic potential in an axial direction of said multipole rods, and a supplemental AC voltage is applied to at least one of said vane electrodes for ejecting a part of the trapped ions, and wherein said second ion trap is adapted to accumulate ions by increasing and decreasing the potential of the end lens disposed at the exit end from the potential on the center axis of said rods to eject them to said time-of-flight mass spectrometer.

4. A mass spectrometer, comprising:

an ionization source for generating ions;

an ion transfer optics for transferring said ions;

a first ion trap for trapping said ions and ejecting a part of the trapped ions with at least two m/z ranges sequentially;

a second ion trap for trapping the ions ejected from said first ion trap and ejecting them in pulse form; and a time-of-flight mass spectrometer for accelerating the ions ejected from said second ion trap in the orthogonal direction to the introduction direction, wherein said first ion trap has four or more multipole rods to which a main RF voltage is applied, and vane electrodes which can form a harmonic potential in an axial direction of said multipole rods, and a supplemental AC voltage is applied to at least one of said vane electrodes for ejecting a part of the trapped ions, and wherein a resonant frequency voltage of said supplemental AC voltage has a superimposing of a single RF voltage.

5. A mass spectrometer, comprising:

an ionization source for generating ions;

an ion transfer optics for transferring said ions;

a first ion trap for trapping said ions and ejecting a part of the trapped ions with at least two m/z ranges sequentially;

a second ion trap for trapping the ions ejected from said first ion trap and ejecting them in pulse form;

a controller; and a time-of-flight mass spectrometer for accelerating the ions ejected from said second ion trap in the orthogonal direction to the introduction direction, wherein said first ion trap has four or more multipole rods to which a main RF voltage is applied, and vane electrodes which can form a harmonic potential in an axial direction of said multipole rods, and a supplemental AC voltage is applied to at least one of said vane electrodes for ejecting a part of the trapped ions, and wherein the controller is adapted to changes at least one of said supplemental AC voltage or said main RF voltage in order to eject ions in said different m/z range from said first ion trap.

* * * * *